US008267738B2

(12) United States Patent
Nuttall

(10) Patent No.: US 8,267,738 B2
(45) Date of Patent: Sep. 18, 2012

(54) TOY

(75) Inventor: Michael Nuttall, South Pasadena, CA (US)

(73) Assignee: Mattel, Inc., El Segundo, CA (US)

( * ) Notice: Subject to any disclaimer, the term of this patent is extended or adjusted under 35 U.S.C. 154(b) by 0 days.

(21) Appl. No.: 13/098,904

(22) Filed: May 2, 2011

(65) Prior Publication Data

US 2011/0269372 A1 Nov. 3, 2011

Related U.S. Application Data

(60) Provisional application No. 61/329,946, filed on Apr. 30, 2010.

(51) Int. Cl.
*A63H 18/00* (2006.01)
*A63H 29/08* (2006.01)

(52) U.S. Cl. ..... 446/444; 446/153; 446/429

(58) Field of Classification Search ..... 446/71, 446/89, 153, 171, 214, 236, 237, 423, 425–431, 446/444–448, 465, 467
See application file for complete search history.

(56) References Cited

U.S. PATENT DOCUMENTS

| | | | |
|---|---|---|---|
| 1,715,891 | A | 6/1929 | Beck |
| 2,917,864 | A | 12/1959 | Payne |
| 3,209,491 | A | 10/1965 | Roeper |
| 3,298,692 | A | 1/1967 | Glass et al. |
| 3,300,891 | A | 1/1967 | Glass et al. |
| 3,315,632 | A | 4/1967 | Hyden |
| 3,379,440 | A | 4/1968 | Jaffe |
| 3,577,675 | A | 5/1971 | Kohner et al. |
| 3,908,989 | A | 9/1975 | Meyer |

(Continued)

FOREIGN PATENT DOCUMENTS

KR 20-0166122 Y1 2/2000

(Continued)

OTHER PUBLICATIONS

Written Opinion for International Application No. PCT/US2011/034793; Date of Mailing: Feb. 9, 2012.

(Continued)

*Primary Examiner* — Nini Legesse
(74) *Attorney, Agent, or Firm* — Cantor Colburn LLP

(57) ABSTRACT

A track set is disclosed herein, the track set having: a first track segment pivotally mounted to the track set for movement between a first position and a second position, the first track segment having a first end and a second end; a perforated vessel secured to the first end of the first track segment, wherein a predetermined amount of water in the perforated vessel will maintain the first track segment in the first position; a second track segment mounted to the track set, the second end of the first track segment being spaced from a receiving end of the second track segment and the second end of the first track segment being elevated from the receiving end of the second track segment when the first track segment is in the first position, wherein at least one toy vehicle positioned proximate to the first end of the first track segment will be held there until an amount of water in the perforated vessel is less than the predetermined amount and the first track segment moves from the first position to the second position, wherein the least one toy vehicle travels away from the first end of the first track segment to the second track segment by traversing a gap between the second end of the first track segment and the receiving end of the second track segment.

19 Claims, 4 Drawing Sheets

U.S. PATENT DOCUMENTS

| | | | |
|---|---|---|---|
| 4,077,628 | A | 3/1978 | Hebert |
| 4,249,733 | A | 2/1981 | Eddins et al. |
| 4,348,028 | A | 9/1982 | Barlow |
| 4,605,229 | A | 8/1986 | McKay |
| 4,778,430 | A | 10/1988 | Goldfarb et al. |
| 4,932,917 | A | 6/1990 | Klitsner |
| 5,078,642 | A | 1/1992 | Glessner |
| 5,336,122 | A | 8/1994 | Lewis |
| 5,651,736 | A | 7/1997 | Myers |
| 5,683,298 | A | 11/1997 | Jackson |
| 5,839,964 | A | 11/1998 | Rudell et al. |
| 6,056,623 | A | 5/2000 | Arriola |
| 6,340,323 | B1 | 1/2002 | Glynn |
| 6,676,480 | B2 | 1/2004 | Sheltman |
| 7,690,964 | B2 | 4/2010 | Nuttall et al. |
| 2003/0224696 | A1 | 12/2003 | Sheltman |
| 2003/0224697 | A1 | 12/2003 | Sheltman et al. |
| 2005/0191938 | A1 | 9/2005 | Sheltman et al. |
| 2005/0191940 | A1 | 9/2005 | Sheltman et al. |
| 2007/0128969 | A1 | 6/2007 | Shrock et al. |
| 2007/0197127 | A1 | 8/2007 | Ostendorff et al. |
| 2008/0009219 | A1 | 1/2008 | Nuttall et al. |
| 2008/0070474 | A1 | 3/2008 | Nuttall |

FOREIGN PATENT DOCUMENTS

| | | | |
|---|---|---|---|
| KR | 1020050002802 | A | 1/2005 |
| KR | 1020050084633 | A | 8/2005 |

OTHER PUBLICATIONS

International Search Report for International Application No. PCT/US2011/034793; Date of Mailing: Feb. 9, 2012.

TOY

This application claims the benefit of U.S. patent application No. 61/329,946 filed Apr. 30, 2010, the contents of which are incorporated herein by reference thereto.

BACKGROUND

Various embodiments of the present invention are related to toys and in particular, a structure for use in racing toy vehicles.

Toy vehicle track sets have been popular for many years and generally include one or more track sections arranged to form a path around which one or more toy vehicles can travel. Toy vehicles which may be used on such track sets may be either self-powered vehicles or may receive power from an external source. In order to increase play value of the track sets, it is desirable to add track amusement features to the track sets. Furthermore, you children enjoy playing with toys in the water whether it is a tub, pool, beach etc.

Accordingly, it is desirable to provide a toy structure that will provide variations in play.

SUMMARY OF THE INVENTION

In one embodiment, a track set is provided, the track set having: a first track segment pivotally mounted to the track set for movement between a first position and a second position, the first track segment having a first end and a second end; a perforated vessel secured to the first end of the first track segment, wherein a predetermined amount of water in the perforated vessel will maintain the first track segment in the first position; a second track segment mounted to the track set, the second end of the first track segment being spaced from a receiving end of the second track segment and the second end of the first track segment being elevated from the receiving end of the second track segment when the first track segment is in the first position, wherein at least one toy vehicle positioned proximate to the first end of the first track segment will be held there until an amount of water in the perforated vessel is less than the predetermined amount and the first track segment moves from the first position to the second position, wherein the least one toy vehicle travels away from the first end of the first track segment to the second track segment by traversing a gap between the second end of the first track segment and the receiving end of the second track segment.

In another embodiment, a track set is provided, the track set having: a first track segment pivotally mounted to the track set for movement between a first position and a second position, the first track segment having a first end and a second end; a perforated vessel secured to the first end of the first track segment, wherein a predetermined amount of water in the perforated vessel will maintain the first track segment in the first position; a second track segment mounted to the track set, the second end of the first track segment being located proximate to a receiving end of the second track segment and the second end of the first track segment being elevated from the receiving end of the second track segment when the first track segment is in the first position, wherein at least one toy vehicle positioned proximate to the first end of the first track segment will be held there until an amount of water in the perforated vessel is less than the predetermined amount and the first track segment moves from the first position to the second position, wherein the least one toy vehicle travels away from the first end of the first track segment to the second track segment.

In another exemplary embodiment, a method of racing at least two toy vehicles is provided. The method including the steps of: maintaining a first track segment pivotally mounted to a track set in a first position by placing a predetermined amount of water in a perforated vessel secured to a first end of the first track segment; draining water from the perforated vessel until an amount of water in the perforated vessel is less than the predetermined amount and the first track segment moves from the first position to a second position, wherein the least one toy vehicle travels away from the first end of the first track segment to a second track segment by traversing a gap between a second end of the first track segment and a receiving end of the second track segment.

BRIEF DESCRIPTION OF THE DRAWINGS

Other features, advantages and details appear, by way of example only, in the following description of embodiments, the description referring to the drawings in which.

DETAILED DESCRIPTION

Figure 1:
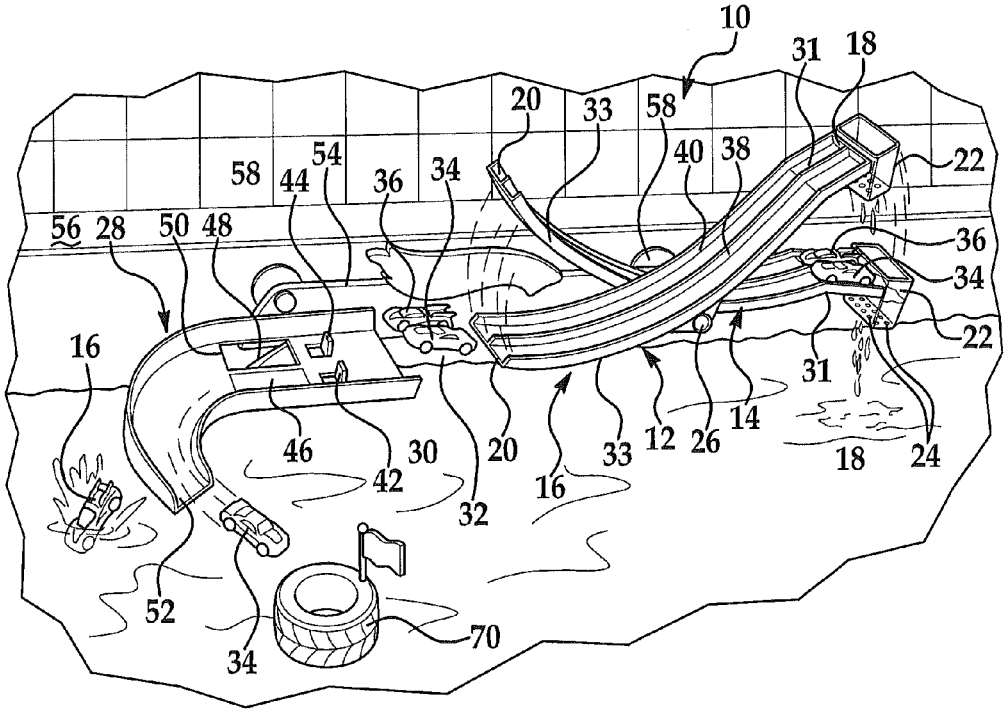
FIGS. 1-3 are perspective views of a track set in accordance with an exemplary embodiment of the present invention.
Figure 2:
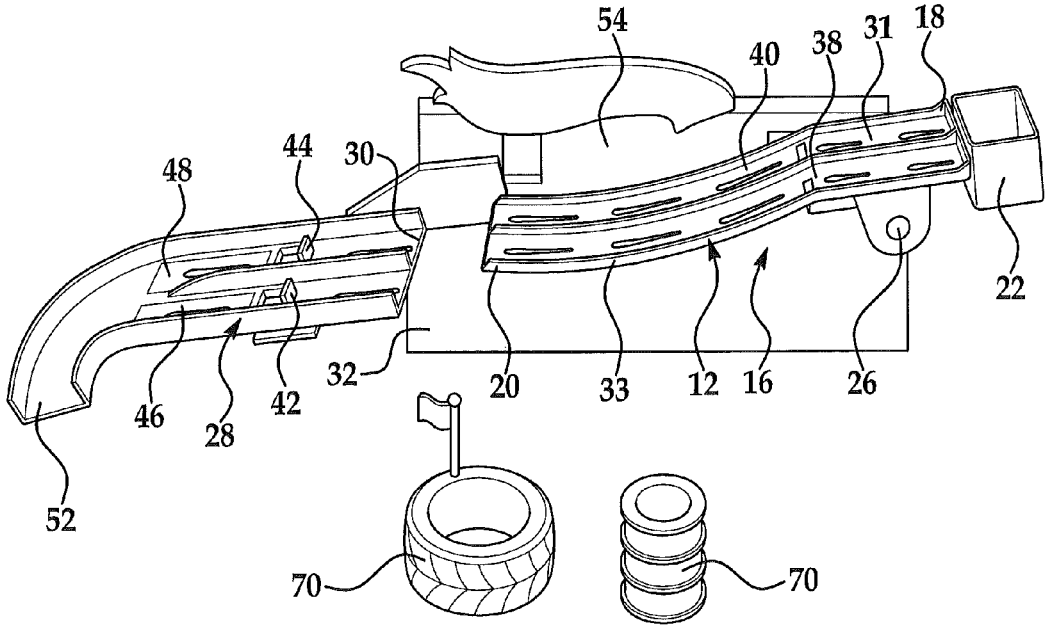
Figure 3:
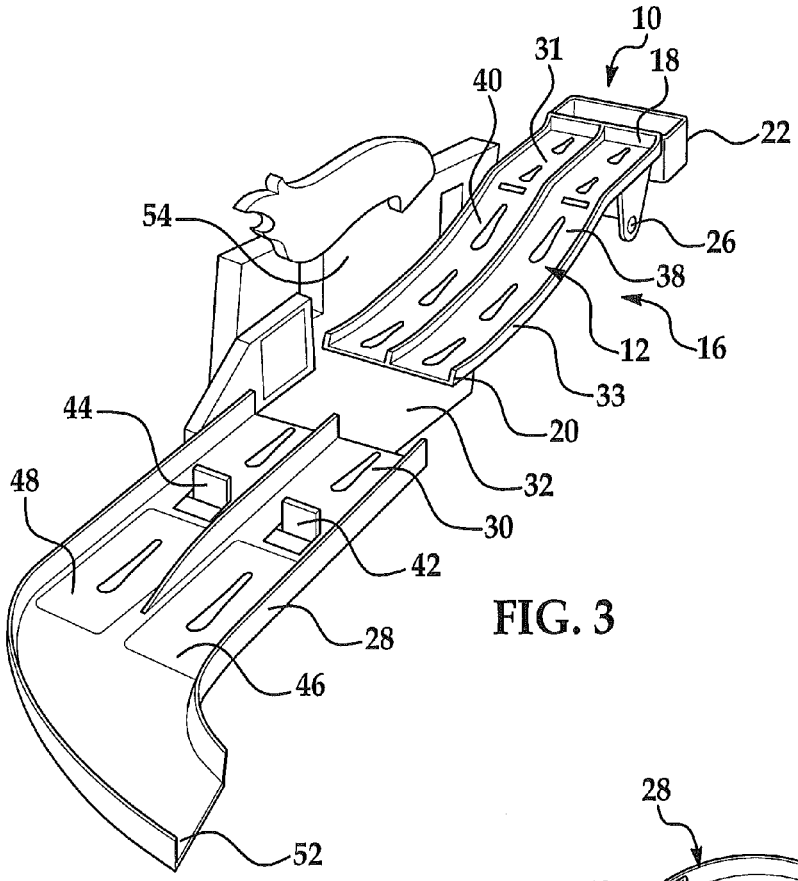
Figure 4:
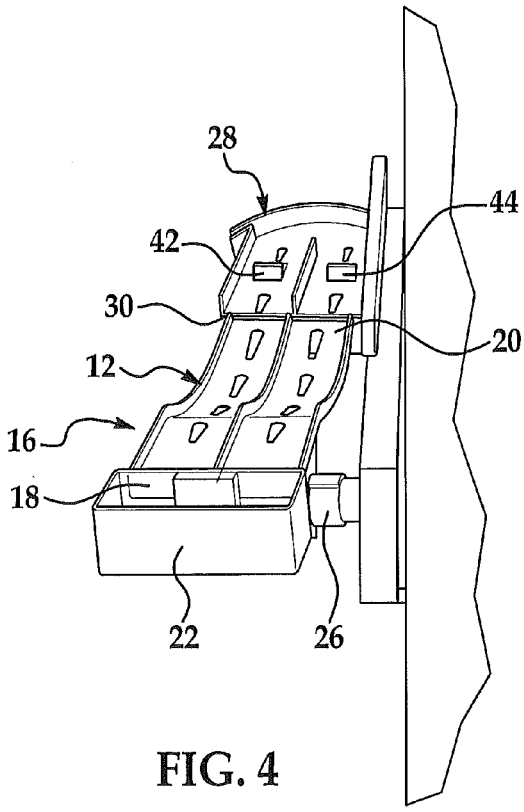
FIG. 4 is an end perspective view of a track set in accordance with an exemplary embodiment of the present invention.
Figure 5:
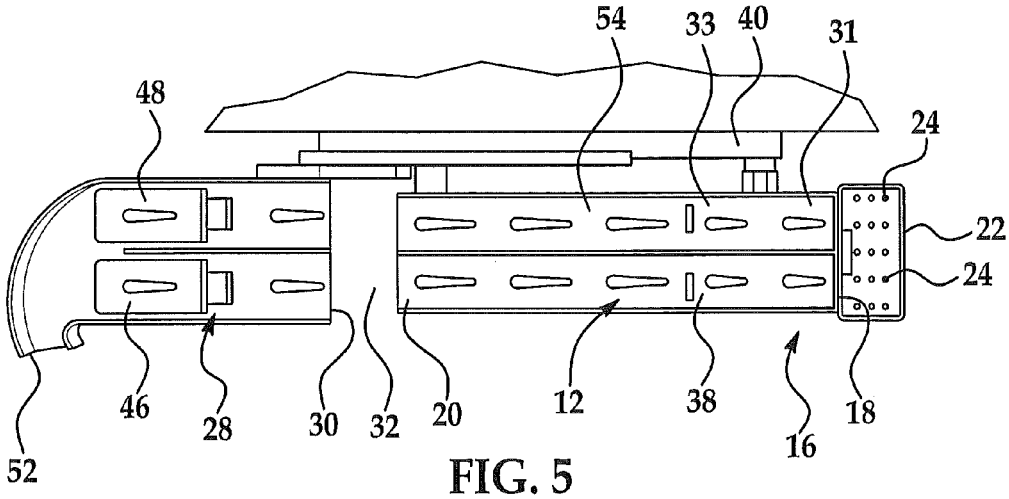
FIG. 5 is a top perspective view of a track set in accordance with an exemplary embodiment of the present invention.
Figure 6:
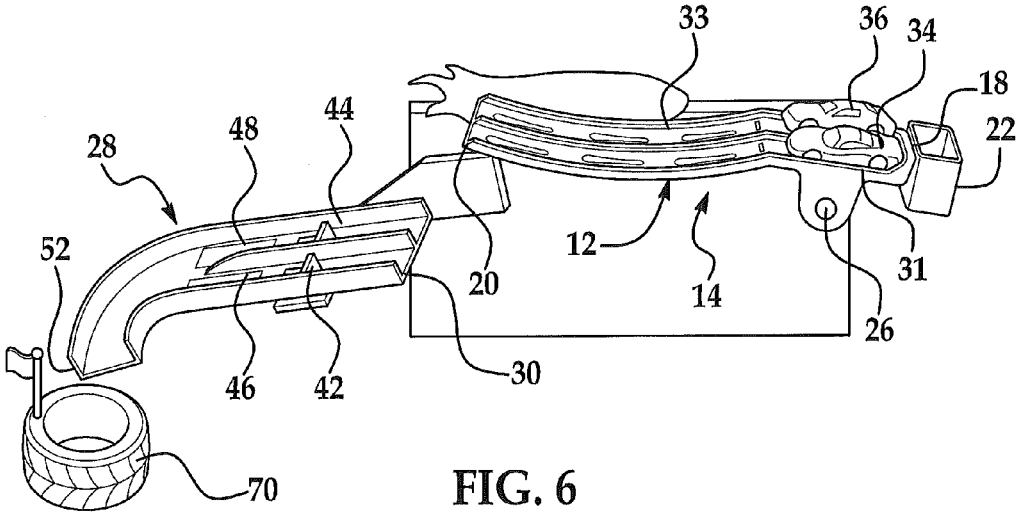
FIGS. 6-9 are views illustrating two toys vehicles racing each other on the track set of an exemplary embodiment of the present invention.
Figure 7:
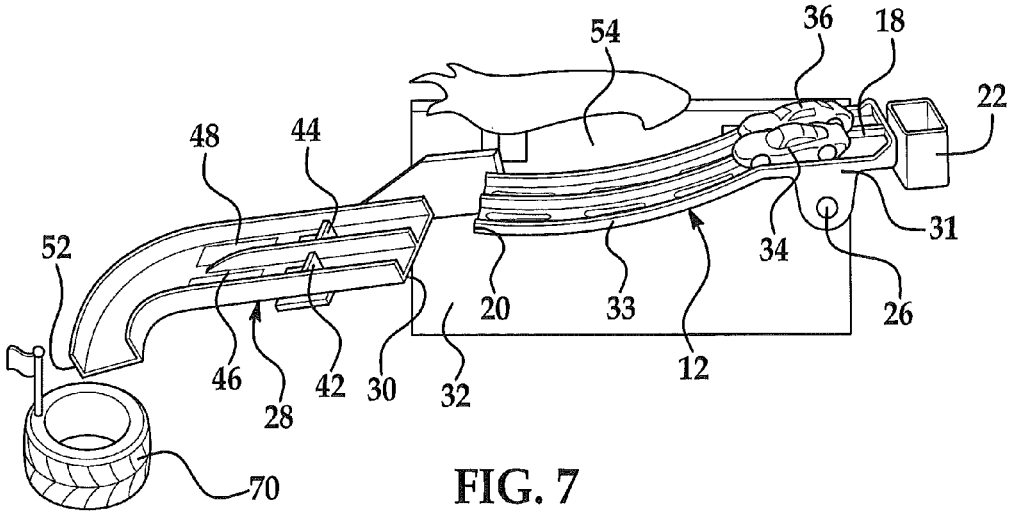
Figure 8:
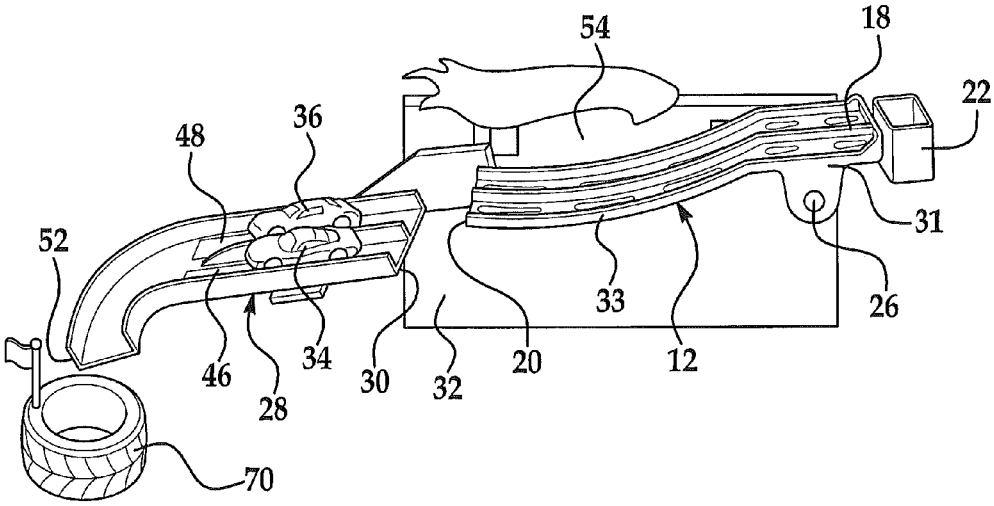
Figure 9:
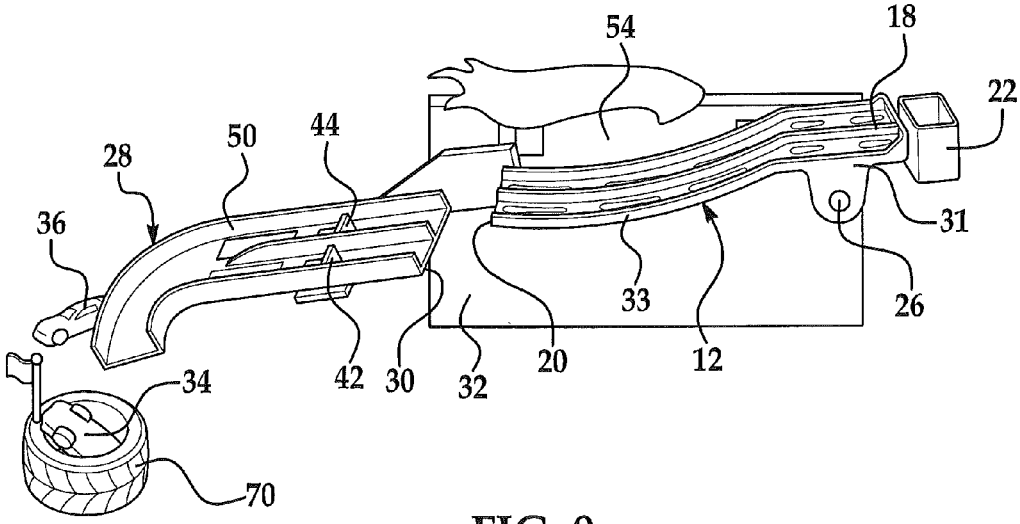

In accordance with various embodiments of the present invention and referring now to FIGS. 1-9, a track set 10 is illustrated. In one non-limiting embodiment, the track set is configured for use with a body of water for example, in a tub. As illustrated, the track set has a first track segment 12 pivotally mounted to the track set for movement between a first position 14 and a second position 16, the first track segment having a first end 18 and a second end 20. The first position 14 and the second position 16 being illustrated in at least FIG. 1.

A perforated vessel 22 is secured to the first end of the first track segment, wherein a predetermined amount of water in the perforated vessel will maintain the first track segment in the first position. In other words, the first track segment act as a teeter tooter or a cantilevered arm that will stay in the first position when a sufficient weight is in the vessel via a body of water. Due to a plurality of apertures or openings 24 in the vessel, water will drain out of the vessel until the weight of the second end of the first track segment is sufficient to pivot or rotate the first track segment about a pivot point 26 to the second position and thus be in a position to start a race of two objects down the first track segment. Alternatively, other fluids and/or materials can be used in the perforated vessel to start the race. For example, sand may be placed in the perforated vessel and the sand can travel out of the openings and provide the necessary means for keeping the first track segment in the first position for a limited period of time until the sand has traveled out of the perforated vessel.

The track set also has a second track segment 28 mounted to the track set. As illustrated, the second end of the first track segment is spaced from a receiving end 30 of the second track segment such that a gap 32 is formed therebetween. Of course and in alternative embodiments, there is no gap between the two track segments and the second end of the first track segment moves proximate to the receiving end of the second track segment. Also shown in the FIGS. is that the first track segment has a flat portion 31 proximate to the first end and a curved portion 33 extending therefrom. Of course, other track configurations are contemplated to be within the scope of exemplary embodiments.

When the first track segment is in the first position, the second end of the first track segment is elevated from the receiving end of the second track segment and at least one toy vehicle positioned proximate to the first end of the first track segment will be held there until an amount of water in the perforated vessel is less than the predetermined amount and the weight of first track segment to the left of the pivot point 26 moves the first track segment toward the second position. As this occurs, a pair of toy vehicles 34 and 36 travel away from the first end of the first track segment and towards the second track segment and ultimately onto the second track segment by traversing the gap 32. Although, two toy vehicles are shown it is understood that exemplary embodiments of the present invention contemplate numbers greater or less two toy vehicles and exemplary embodiments are not intended to be limited to the specific track configurations illustrated herein.

Accordingly, the first track segment when in the first position is used to start a race of two objects or toy vehicles in that the first track segment is downwardly sloping downwardly toward the second track segment when it is in the second position such that the toy vehicles will both roll or traverse down the first track segment towards the second track segment due to gravity forces acting upon the toy vehicles. Accordingly, pivotal movement of the first track segment from the first position to the second position provides a means for starting a race of two toy vehicles down their respective paths of travel up the track set. In addition, the gravity forces acting upon the toy vehicles will be sufficient enough to generate a velocity in the vehicles such that they will be able to traverse the gap between the first track segment and the second track segment.

As shown, the first track segment is configured to define two parallel track paths 38 and 40 for receipt of vehicles 34 and 36 thereon. The second track segment has a pair of triggers 42 and 44 movably secured thereto and each trigger is aligned with a respective one of the parallel track paths of the first track segment. The pair of triggers are each configured to be contacted by an object or vehicle travelling along a respective path of the second track segment and the pair of triggers are each configured to be cross-linked to a releaseable trap door 46 and 48 of the second track segment via linkage members in that actuation of trigger 42 in a first path of travel will open door 46 in a second path of travel and actuation of trigger 44 in the second path of travel will open door 48 in the first path of travel. In addition and in one embodiment, the triggers are further configured that only one trigger will be actuated during each race. Still further, the pair of triggers are configured (e.g., a portion thereof is located in the vehicle path) to be contacted by an incoming vehicle on the second track segment. Triggers 42 and 44 can be any type of reloadable triggers known to those skilled in the related arts wherein movement of the trigger from one position to another position releases a catch that allows a trap door to open. The trap doors 46 and 48 are pivotally secured to the second track segment and may move to the open position via gravity or a spring biasing force or a combination thereof.

For example and during a race wherein the water draining from the perforated vessel of the first track segment is used to start the race by allowing the first track segment to pivot to the second position from the first position as the water drains from the perforated vessel. Once this occurs, the race starts and the two vehicles start traversing down the first track segment along their respective paths. The first one of the pair of toy vehicles to traverse from the first track segment to the second track segment in a first path of travel will actuate one of the pair of triggers and open the releasable trap door in front of a second one of pair of toy vehicles to traverse from the first track segment to the second track segment in a second path of travel such that the second one of pair of toy vehicles to traverse from the first track segment to the second track segment will fall through an opening 50 in the second track segment while the first one of the pair of toy vehicles to traverse from the first track segment to the second track segment will pass through an exit end 52 of the second track segment. As discussed above, the first path of travel is parallel to the second path of travel. Of course, other configurations are contemplated to be within the scope of exemplary embodiments of the present invention. As illustrated in FIG. 1, car 34 traverses from the first track segment to the second track segment first and thus car 36 will fall through opening 50. After the race is completed the triggers and the released trap door are repositioned to an unreleased state.

Accordingly, the winner of the race is the first vehicle to traverse the gap and contact one of the triggers thus opening a trapdoor in front of the other vehicle or loser of the race such that the losing vehicle falls through the opening and into the water.

In one embodiment, the first track segment and the second track segment are each secured to a member 54 configured to mount the track set to a surface 56. Accordingly, the first track segment is pivotally mounted to member 54. In one non-limiting embodiment, the member 54 has a plurality of suction cups 58 secured thereto. As illustrated in at least FIG. 1 the track set is configured to be mounted to a side of a tub.

In still another alternative a floating target 70 is provided to provide an added feature to aim the toy vehicle at as it exits from the exit end of the second track segment. In the illustrated non-limiting embodiment, target 70 is shaped in the form of a tire or barrel such that a vehicle can be launched at the opening in the target.

Accordingly and in operation, the first track segment maintained in the first position by placing a predetermined amount of water in the perforated vessel secured to the first end of the first track segment, thereafter the water drains from the vessel until an amount of water in the perforated vessel is less than the predetermined amount and the first track segment moves from the first position to a second position, wherein the least one toy vehicle travels away from the first end of the first track segment to a second track segment.

While the invention has been described with reference to an exemplary embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. A track set, comprising:

a first track segment pivotally mounted to the track set for movement between a first position and a second position, the first track segment having a first end and a second end;

a perforated vessel secured to the first end of the first track segment, wherein a predetermined amount of water in the perforated vessel will maintain the first track segment in the first position; and a second track segment mounted to the track set, the second end of the first track segment being spaced from a receiving end of the second track segment and the second end of the first track segment being elevated from the receiving end of the second track segment when the first track segment is in the first position, wherein at least one toy vehicle positioned proximate to the first end of the first track segment will be held there until an amount of water in the perforated vessel is less than the predetermined amount and the first track segment moves from the first position to the second position, wherein the least one toy vehicle travels away from the first end of the first track segment to the second track segment by traversing a gap between the second end of the first track segment and the receiving end of the second track segment.

2. The track set as in claim 1, wherein the first track segment is configured to define two parallel track paths and the at least one toy vehicle is a pair of toy vehicles each being placed in a respective one of the parallel track paths.

3. The track set as in claim 2, wherein the second track segment has a pair of triggers each being aligned with a respective one of the parallel track paths of the first track segment and the pair of triggers are configured to be cross linked to a releaseable trap door of the second track segment such that a first one of the pair of toy vehicles to traverse from the first track segment to the second track segment will actuate one of the pair of triggers and the releasable trap door in front of a second one of pair of toy vehicles to traverse from the first track segment to the second track segment such that the second one of pair of toy vehicles to traverse from the first track segment to the second track segment will fall through an opening in the second track segment while the first one of the pair of toy vehicles to traverse from the first track segment to the second track segment will pass through an exit end of the second track segment.

4. The track set as in claim 3, wherein the first track segment and the second track segment are each secured to a member configured to mount the track set to a surface.

5. The track set as in claim 4, wherein the member has a plurality of suction cups secured thereto.

6. The track set as in claim 1, wherein the first track segment has a flat portion and a curved portion, the flat portion being proximate to the first end of the first track segment.

7. A method of racing at least two toy vehicles, comprising:

maintaining a first track segment pivotally mounted to a track set in a first position by placing a predetermined amount of water in a perforated vessel secured to a first end of the first track segment; and draining water from the perforated vessel until an amount of water in the perforated vessel is less than the predetermined amount and the first track segment moves from the first position to a second position, wherein the least one toy vehicle travels away from the first end of the first track segment to a second track segment by traversing a gap between a second end of the first track segment and a receiving end of the second track segment.

8. The method as in claim 7, wherein the first track segment is configured to define two parallel track paths and the at least one toy vehicle is a pair of toy vehicles each being placed in a respective one of the parallel track paths.

9. The method as in claim 8, wherein the second track segment has a pair of triggers each being aligned with a respective one of the parallel track paths of the first track segment and the pair of triggers are configured to be cross linked to a releaseable trap door of the second track segment such that a first one of the pair of toy vehicles to traverse from the first track segment to the second track segment will actuate one of the pair of triggers and the releasable trap door in front of a second one of pair of toy vehicles to traverse from the first track segment to the second track segment such that the second one of pair of toy vehicles to traverse from the first track segment to the second track segment will fall through an opening in the second track segment while the first one of the pair of toy vehicles to traverse from the first track segment to the second track segment will pass through an exit end of the second track segment.

10. The method as in claim 9, wherein the first track segment and the second track segment are each secured to a member configured to mount the track set to a surface.

11. The method as in claim 10, wherein the member has a plurality of suction cups secured thereto.

12. The method as in claim 7, wherein the first track segment has a flat portion and a curved portion, the flat portion being proximate to the first end of the first track segment.

13. The method as in claim 7, wherein the first track segment and the second track segment are each secured to a member configured to mount the track set to a surface and wherein the member has a plurality of suction cups secured thereto.

14. A track set, comprising:

a first track segment pivotally mounted to the track set for movement between a first position and a second position, the first track segment having a first end and a second end;

a perforated vessel secured to the first end of the first track segment, wherein a predetermined amount of water in the perforated vessel will maintain the first track segment in the first position; and a second track segment mounted to the track set, the second end of the first track segment being located proximate to a receiving end of the second track segment and the second end of the first track segment being elevated from the receiving end of the second track segment when the first track segment is in the first position, wherein at least one toy vehicle positioned proximate to the first end of the first track segment will be held there until an amount of water in the perforated vessel is less than the predetermined amount and the first track segment moves from the first position to the second position, wherein the least one toy vehicle travels away from the first end of the first track segment to the second track segment.

15. The track set as in claim 14, wherein the first track segment is configured to define two parallel track paths and the at least one toy vehicle is a pair of toy vehicles each being placed in a respective one of the parallel track paths.

16. The track set as in claim 15, wherein the second track segment has a pair of triggers each being aligned with a respective one of the parallel track paths of the first track segment and the pair of triggers are configured to be cross linked to a releasable trap door of the second track segment such that a first one of the pair of toy vehicles to traverse from the first track segment to the second track segment will actuate one of the pair of triggers and the releasable trap door in front of a second one of pair of toy vehicles to traverse from the first track segment to the second track segment such that the second one of pair of toy vehicles to traverse from the first track segment to the second track segment will fall through an opening in the second track segment while the first one of the pair of toy vehicles to traverse from the first track segment to the second track segment will pass through an exit end of the second track segment.

17. The track set as in claim 16, wherein the first track segment and the second track segment are each secured to a member configured to mount the track set to a surface.

18. The track set as in claim 17, wherein the member has a plurality of suction cups secured thereto.

19. The track set as in claim 14, wherein the first track segment has a flat portion and a curved portion, the flat portion being proximate to the first end of the first track segment.

* * * * *